US009888829B1

(12) United States Patent
Bongivengo

(10) Patent No.: US 9,888,829 B1
(45) Date of Patent: Feb. 13, 2018

(54) FORCED AIR DRYING DISHWASHER

(71) Applicant: Joseph Bongivengo, Edinburg, PA (US)

(72) Inventor: Joseph Bongivengo, Edinburg, PA (US)

( * ) Notice: Subject to any disclaimer, the term of this patent is extended or adjusted under 35 U.S.C. 154(b) by 0 days.

(21) Appl. No.: 14/708,864

(22) Filed: May 11, 2015

(51) Int. Cl.
*A47L 15/48* (2006.01)
*A47L 15/42* (2006.01)

(52) U.S. Cl.
CPC ..... *A47L 15/486* (2013.01); *A47L 15/4278* (2013.01)

(58) Field of Classification Search
USPC ..... 134/102.3, 99.1
See application file for complete search history.

(56) References Cited

U.S. PATENT DOCUMENTS 3,103,227 A * 9/1963 Long ..... A47L 15/06 134/105
4,179,821 A * 12/1979 Herbst ..... A47L 15/4257 134/182
5,076,306 A 12/1991 Suzuki et al.
5,337,500 A * 8/1994 Enokizono ..... A47L 15/486 34/225
6,053,185 A * 4/2000 Beevers ..... A47L 15/488 134/102.3
6,869,029 B2 * 3/2005 Ochoa, Sr. ..... A47L 15/508 134/176
8,231,737 B2 7/2012 Iwanaga et al.
2012/0138092 A1 * 6/2012 Ashrafzadeh ..... A47L 15/4295 134/18

* cited by examiner

*Primary Examiner* — Michael E Barr
*Assistant Examiner* — Cristi J Tate-Sims
(74) *Attorney, Agent, or Firm* — Stevenson IP, LLC

(57) ABSTRACT

The forced air drying dishwasher provides an intake and air channel that ensure a smooth and more than adequate air entry, coupled with a narrowed venturi area to accelerate an air flow into a blower. With the air flow heated by a heating element, a distribution manifold coupled to a pair of nozzle manifolds with a plurality of spaced apart, evenly distributing nozzles are all joined via a plurality of laminar bends to ensure the air flow that is further aided. A gradual bend of an exhaust provides proper exit of the air flow. With such a plurality of air flow enhancements, a drying of dishes is comparatively more hastened and complete.

6 Claims, 5 Drawing Sheets

FORCED AIR DRYING DISHWASHER

BACKGROUND OF THE INVENTION

The need for air drying in a dishwasher has been established. Drying by an interior heat only is not effective and leaves any number of dishes wet if not puddled with water. There is often a need to empty the dishes on a lower shelf first to prevent spillage from an overlying rack. Unloading in a given order is seldom convenient for stowage of the dishes in a plurality of cabinets. Remaining water often spots the dishes and any flatware, also. Of the various dishwashers that are equipped with an air drying feature, several problems have not been successfully addressed. Some use a fresh air or a mix of the fresh air and an interiorly held air, even though mixing the interior air subjects the air drying to much greater humidity and therefore inferior air drying. Some dishwashers equipped with air drying not only fail to effectively cycle the air drying but also fail to evacuate saturated air from the dishwasher. Some dishwashers fail to fully expose all of the dishes within the dishwasher to sufficient air. Another flaw is that some dishwashers fail to provide adequate air flow. A plurality of features needs to be provided in order to effectively air dry the dishes within the dishwasher. Among those features is a generous fresh air intake that channels to a blower without being mixed with saturated air within the dishwasher. Also, the drying air needs to be heated in order to effectively absorb moisture and dry the dishes. Additionally, an effective exhaust must be provided for removal of the saturated air and therein enhance the air intake. The air must also be delivered substantially evenly to the dishes, with many interior outlets needed to accomplish this task, without unduly restrictive flow. The present forced air drying dishwasher meets the feature needs.

FIELD OF THE INVENTION

The present forced air drying dishwasher relates to dishwashers and more especially to dishwashers that provide for air drying of dishes.

SUMMARY OF THE INVENTION

The general purpose of the forced air drying dishwasher, described subsequently in greater detail, is to provide a forced air drying dishwasher that has many novel features that result in a forced air drying dishwasher which is not anticipated, rendered obvious, suggested, or even implied by prior art, either alone or in combination thereof.

To accomplish this, the forced air drying dishwasher has a substantially rectilinear case having a front side, a front top and a front bottom spaced apart from the front top. The dishwasher has a washing tub disposed within the case. The washing tub has a ceiling and a floor spaced apart from the ceiling. The washing tub has a back wall and a hinged door spaced apart from the back wall, a first side and a second side spaced apart from the first side.

An interior space is disposed within the case. The interior space surrounds the ceiling, the floor, the back wall, the first side, and the second side. A louvered intake is disposed within the front side adjacent the front bottom. The louvered intake has a width equal to a width between the first side and the second side. An air channel is disposed within the interior space below the floor. The air channel has a wide mouth tapered to a narrowed venturi area. The wide mouth is affixed adjacent the louvered intake. A blower is disposed within the interior space below the floor. The blower is in direct communication with the narrowed venturi area. A heating element is disposed within the interior space below the floor. The heating element is in operational communication with the blower.

A distribution manifold is disposed within the interior space. The distribution manifold has a plurality of laminar bends. A transfer tube is disposed from the heating element to below and proximal the back wall. A first riser is disposed vertically from the transfer tube to a position proximal the ceiling. The first riser is disposed proximal the back wall and the second side. The first riser is connected to the transfer tube via one laminar bend of the plurality of laminar bends. A second riser is disposed proximal the back wall and the first side. A transverse tube is disposed between the first riser and the second riser. The transverse tube is disposed proximal the back wall and the floor. Two laminar bends of the plurality of laminar bends connect the transverse tube from the first riser to the second riser.

A plurality of horizontally disposed, equally spaced apart nozzle manifolds is provided. The nozzle manifolds are equally distributed between proximal the ceiling to proximal the floor. Three nozzle manifolds of the plurality of nozzle manifolds are proximal the second side and extend from the first riser toward the hinged door. Three nozzle manifolds of the plurality of nozzle manifolds are proximal the first side and extend from the second riser to proximal the hinged door. The nozzle manifolds are connected to each of the first riser and the second riser via a portion of the laminar bends of the plurality of laminar bends. A plurality of mirror image equally spaced apart nozzles is disposed within the first side and the second side. Each nozzle of the plurality of nozzles opens within the washing tub. Three nozzles of the plurality of nozzles are connected to each nozzle manifold of the plurality of nozzle manifolds. The blower and heating element send hot air through the distribution manifold to be delivered through the plurality of nozzles to the interior space.

An exhaust is disposed within the interior space. The exhaust has a gradual bend disposed between the ceiling and the front top. An inlet grill is disposed between the exhaust and the ceiling. An outlet grill is disposed between the exhaust and the front top. The air channel's wide mouth and narrowed venturi area, the distribution manifold, the nozzle manifolds, and the exhaust all contribute to ensuring more than adequate and sufficient air flow to enable a superior comparative efficiency of the dishwasher with forced air drying.

A washing mechanism is disposed within the case. The washing mechanism has a revolving washer disposed within the floor. A plurality of spray jets is disposed within the revolving washer. The washing mechanism includes a water connection and a power connection. The washing mechanism also has a drain connection.

A control panel is disposed within the front top. The control panel is in operational communication with the blower, the heating element, and the washing mechanism.

Thus has been broadly outlined the more important features of the present forced air drying dishwasher so that the detailed description thereof that follows may be better understood and in order that the present contribution to the art may be better appreciated.

BRIEF DESCRIPTION OF THE DRAWINGS

Figures

DETAILED DESCRIPTION OF THE DRAWINGS

Figure 1:
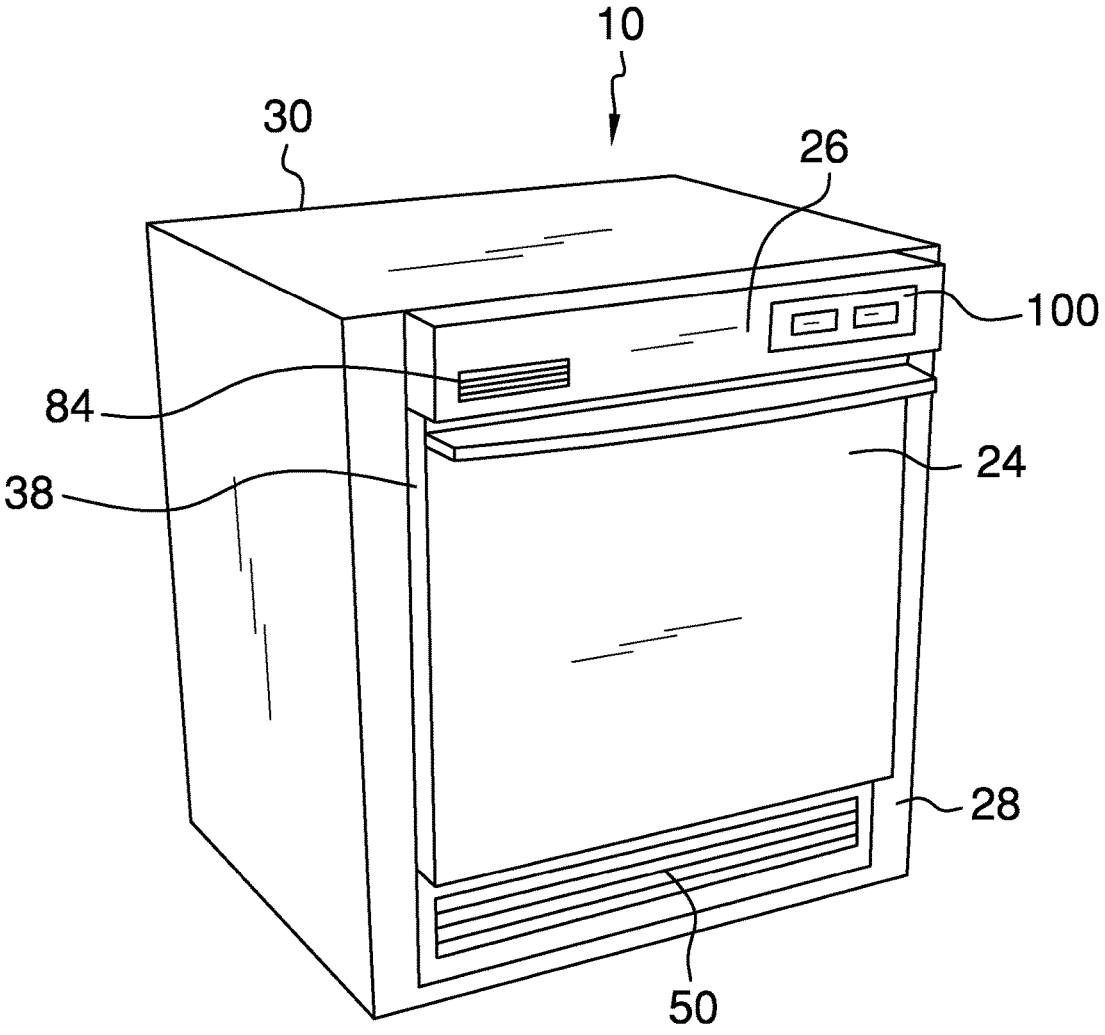
FIG. 1 is a frontal perspective view.
Figure 2:
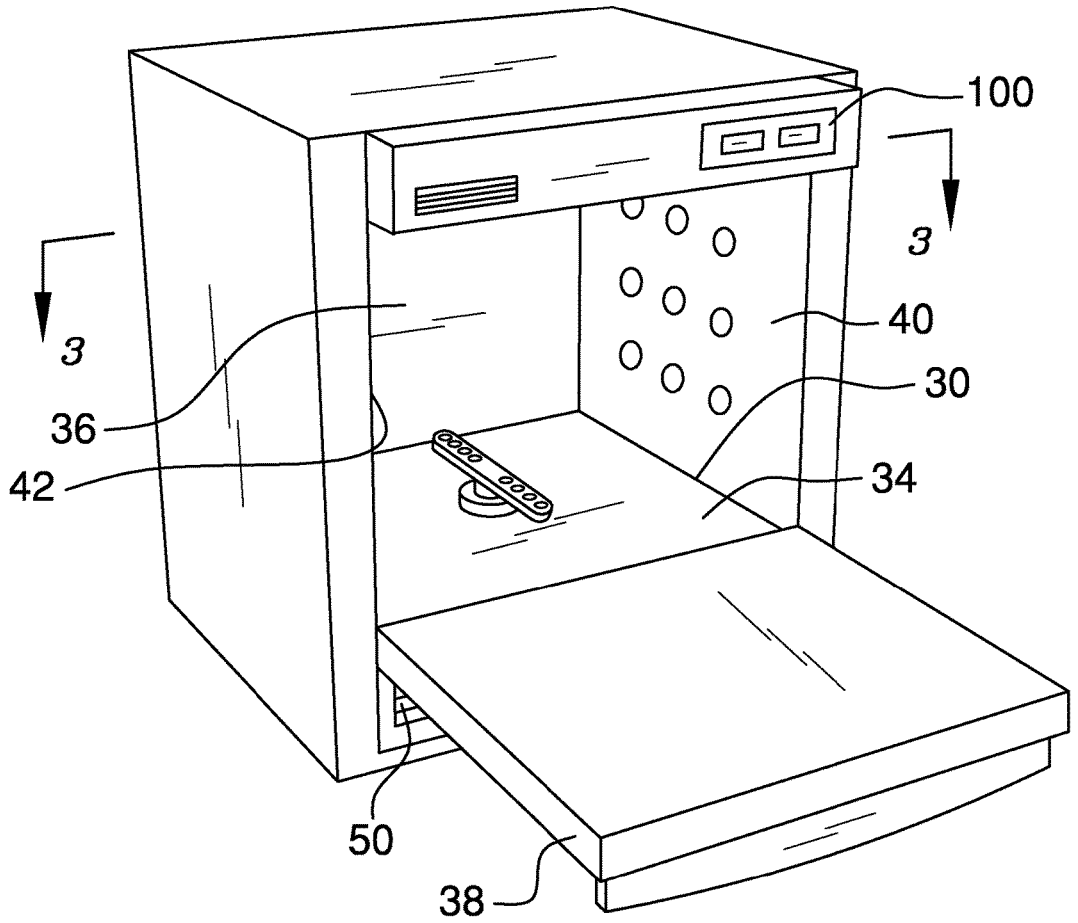
FIG. 2 is a frontal perspective view, a hinged door open.
Figure 3:
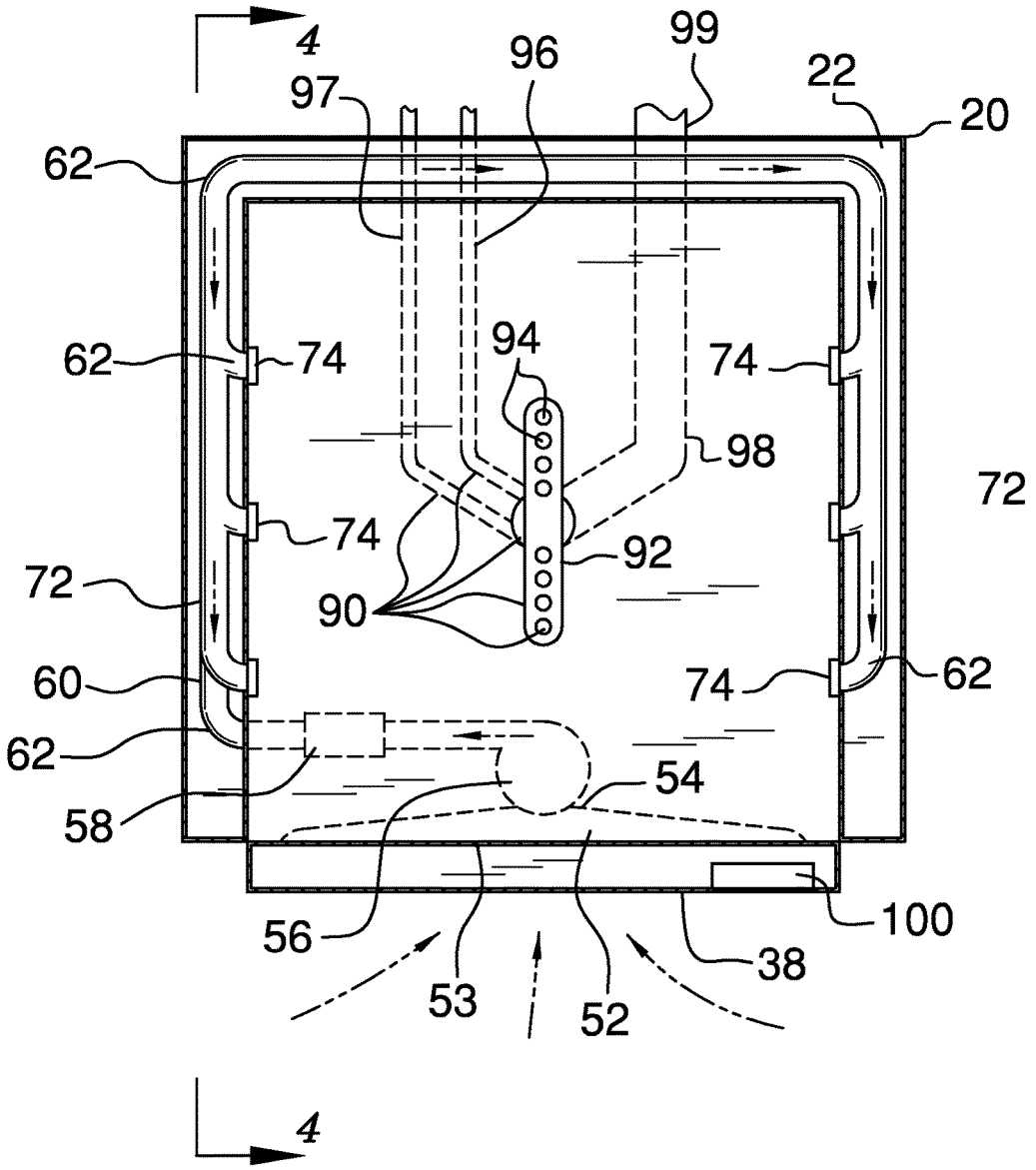
FIG. 3 is a cross sectional view of FIG. 2 taken along the line 3-3.
Figure 4:
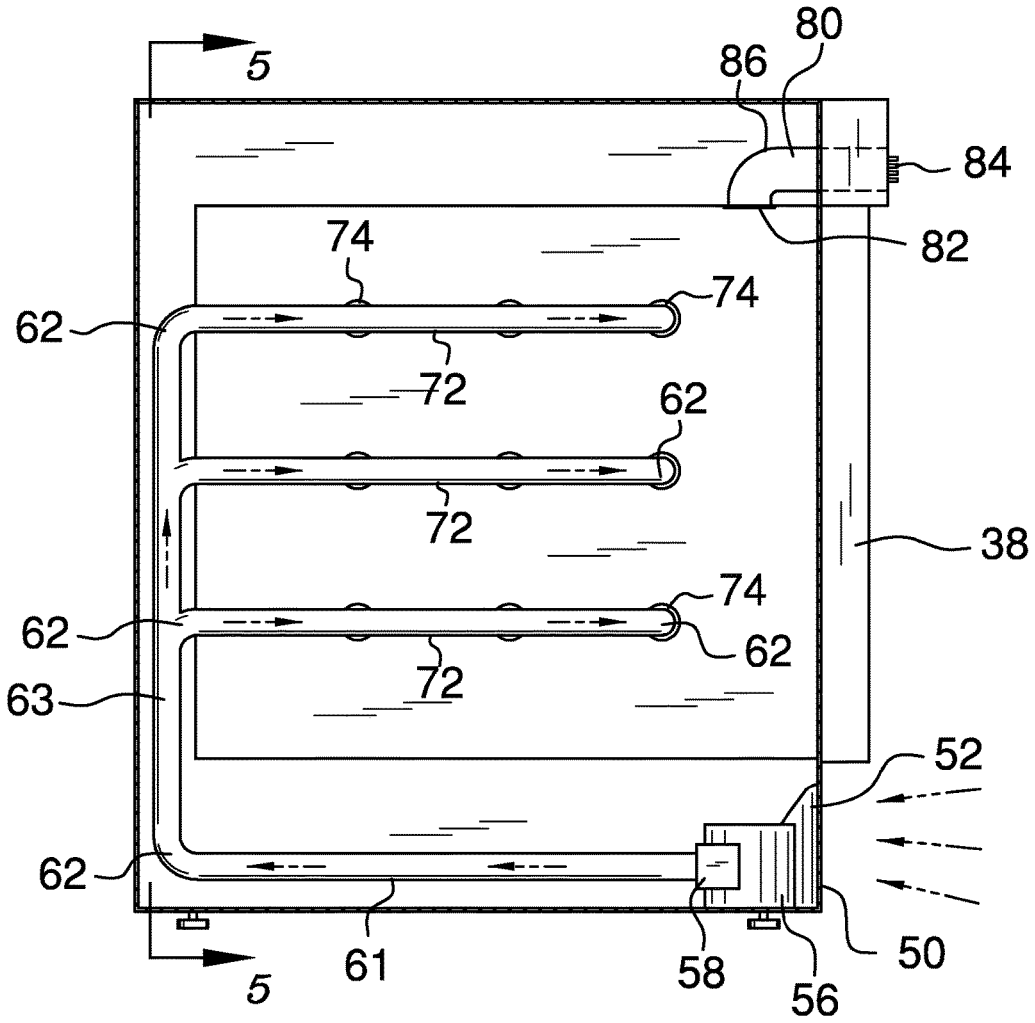
FIG. 4 is a cross sectional view of FIG. 3 taken along the line 4-4.
Figure 5:
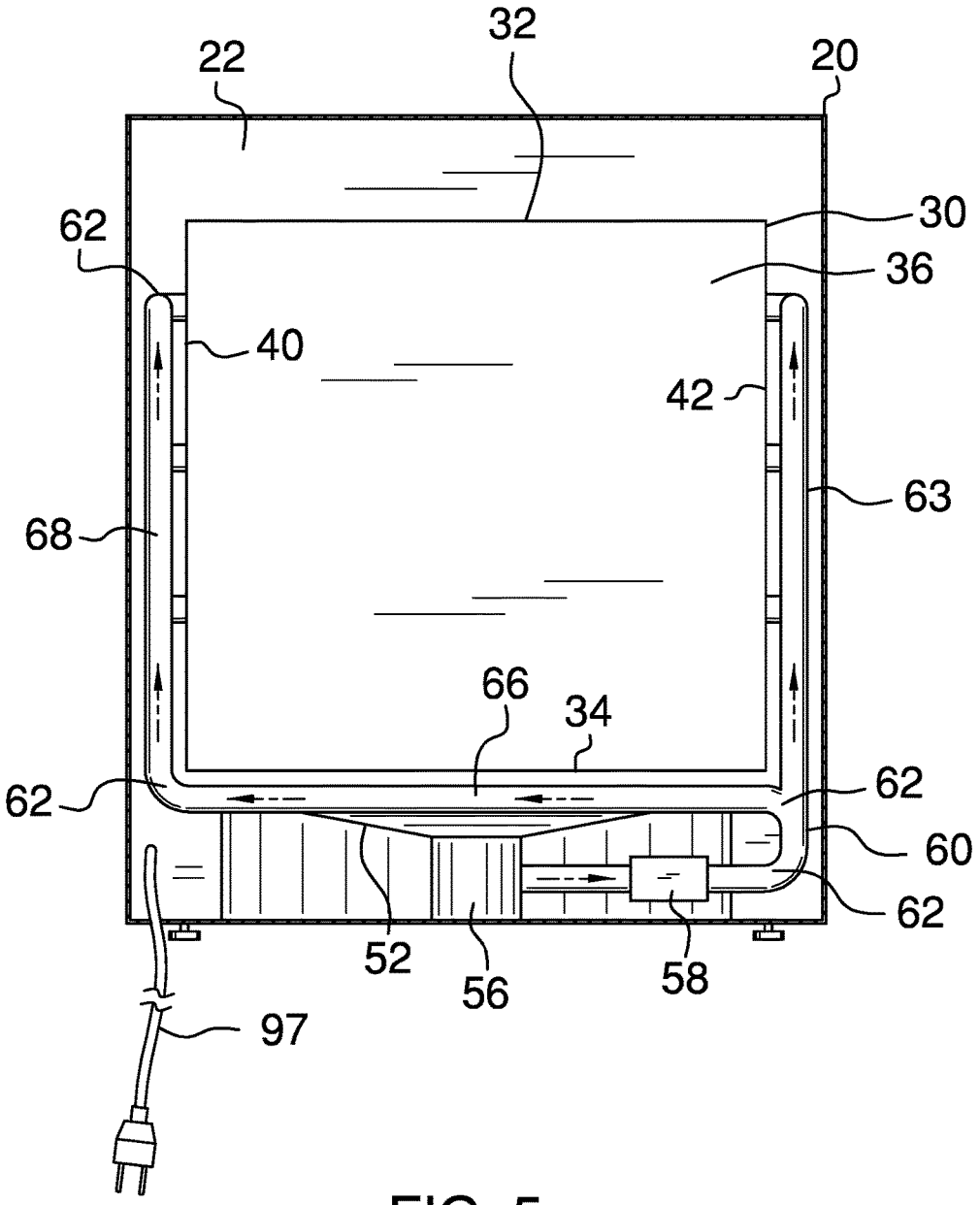
FIG. 5 is a cross sectional view of FIG. 4 taken along the line 5-5.

With reference now to the drawings, and in particular FIGS. 1 through 5 thereof, an example of the forced air drying dishwasher employing the principles and concepts of the present forced air drying dishwasher and generally designated by the reference number 10 will be described.

Referring to FIGS. 1 through 5, the forced air drying dishwasher 10 has a substantially rectilinear case 20 having a front side 24, a front top 26 and a front bottom 28 spaced apart from the front top 26. The dishwasher 10 has a washing tub 30 disposed within the case 20. The washing tub 3—has a ceiling 32 and a floor 34 spaced apart from the ceiling 32. The washing tub 30 has a back wall 36 and a hinged door 38 spaced apart from the back wall 36, a first side 40 and a second side 42 spaced apart from the first side 40.

An interior space 22 is disposed within the case 20. The interior space 22 surrounds the ceiling 32, the floor 34, the back wall 36, the first side 40, and the second side 42. A louvered intake 50 is disposed within the front side 24 adjacent the front bottom 28. The louvered intake 50 has a width equal to a width between the first side 40 and the second side 42. An air channel 52 is disposed within the interior space 22 below the floor 34. The air channel 52 has a wide mouth 53 tapered to a narrowed venturi area 54. The wide mouth 53 is affixed adjacent the louvered intake 50. A blower 56 is disposed within the interior space 22 below the floor 34. The blower 56 is in direct communication with the narrowed venturi area 54. A heating element 58 is disposed within the interior space 22 below the floor 34. The heating element 58 is in operational communication with the blower 56.

A distribution manifold 60 is disposed within the interior space 22. The distribution manifold 60 has a plurality of laminar bends 62. A transfer tube 64 is disposed from the heating element 58 to below and proximal the back wall 36. A first riser 63 is disposed vertically from the transfer tube 64 to a position proximal the ceiling 32. The first riser 63 is disposed proximal the back wall 36 and the second side 42. The first riser 63 is connected to the transfer tube 64 via one laminar bend 62 of the plurality of laminar bends 62. A second riser 68 is disposed proximal the back wall 36 and the first side 40. A transverse tube 66 is disposed between the first riser 63 and the second riser 68. The transverse tube 66 is disposed proximal the back wall 36 and the floor 34. Two laminar bends 62 of the plurality of laminar bends 62 connect the transverse tube 66 from the first riser 68 to the first riser 63.

A plurality of horizontally disposed, equally spaced apart nozzle manifolds 72 is provided. The nozzle manifolds 72 are equally distributed between proximal the ceiling 32 to proximal the floor 34. Three nozzle manifolds 72 of the plurality of nozzle manifolds 72 are proximal the second side 42 and extend from the first riser 63 toward the hinged door 38. Three nozzle manifolds 72 of the plurality of nozzle manifolds 72 are proximal the first side 40 and extend from the second riser 68 to proximal the hinged door 38. The nozzle manifolds 72 are connected to each of the first riser 63 and the second riser 68 via a portion of the laminar bends 62 of the plurality of laminar bends 62. A plurality of mirror image equally spaced apart nozzles 74 is disposed within the first side 40 and the second side 42. Each nozzle of the plurality of nozzles opens within the washing tub 30. Three nozzles 74 of the plurality of nozzles 74 are connected to each nozzle manifold 72 of the plurality of nozzle manifolds 72.

An exhaust 80 is disposed within the interior space 22. The exhaust 80 has a gradual bend 86 disposed between the ceiling 32 and the front top 26. An inlet grill 82 is disposed between the exhaust 80 and the ceiling 32. An outlet grill 84 is disposed between the exhaust 80 and the front top 26.

A washing mechanism 90 is disposed within the case 20. The washing mechanism 90 has a revolving washer 92 disposed within the floor 34. A plurality of spray jets 94 is disposed within the revolving washer 92. The washing mechanism 90 includes a water connection 96 and a power connection 97. The washing mechanism 90 also has a drain connection 99.

A control panel 100 is disposed within the front top 26. The control panel 100 is in operational communication with the blower 56, the heating element 58, and the washing mechanism 100.

What is claimed is:

1. A forced air drying dishwasher comprising:

a substantially rectilinear case having a front side, a front top and a front bottom spaced apart from the front top;

a washing tub disposed within the case, the washing tub having a ceiling and a floor spaced apart from the ceiling, a back wall and a hinged door spaced apart from the back wall, a first side and a second side spaced apart from the first side;

an interior space disposed within the case, the interior space surrounding the ceiling, the floor, the back wall, the first side, and the second side;

an intake disposed within the front side adjacent the front bottom;

an air channel disposed within the interior space below the floor;

a blower disposed within the interior space below the floor, the blower in communication with the air channel;

a distribution manifold disposed within the interior space, the distribution manifold having:

a plurality of laminar bends;

a transfer tube disposed from the blower to below and proximal the back wall;

a first riser disposed vertically from the transfer tube to a position proximal the ceiling, the first riser disposed proximal the back wall and the second side, the first riser connected to the transfer tube via one laminar bend of the plurality of laminar bends;

a second riser disposed proximal the back wall and the first side;

a transverse tube disposed between the first riser and the second riser, the transverse tube disposed proximal the back wall and the floor, two laminar bends of the plurality of laminar bends connecting the transverse tube from the first riser to the second riser;

wherein the distribution manifold receives an air flow from the blower;

a plurality of horizontally disposed, equally spaced apart nozzle manifolds, the nozzle manifolds equally distributed between proximal the ceiling to proximal the floor, three nozzle manifolds of the plurality of nozzle manifolds proximal the second side and extended from the first riser toward the hinged door, three nozzle manifolds of the plurality of nozzle manifolds proximal the first side and extended from the second riser to proximal the hinged door, the nozzle manifolds connected to each of the first riser and the second riser via a portion of the laminar bends of the plurality of laminar bends;

a plurality of mirror image equally spaced apart nozzles disposed within the first side and the second side, each nozzle of the plurality of nozzles open within the washing tub, three nozzles of the plurality of nozzles connected to each nozzle manifold of the plurality of nozzle manifolds;

wherein the plurality of nozzles delivers the air flow from the distribution manifold by way of the plurality of nozzle manifolds to the interior space;

an exhaust disposed within the interior space, the exhaust having a gradual bend disposed between the ceiling and the front top;

a washing mechanism disposed within the case, the washing mechanism having:

a revolving washer disposed within the floor;

a plurality of spray jets disposed within the revolving washer;

a water connection;

a power connection; and a control panel disposed within the front top, the control panel in operational communication with the blower and the washing mechanism.

2. The forced air drying dishwasher of claim 1 having an inlet grill disposed between the exhaust and the ceiling;

an outlet grill disposed between the exhaust and the front top.

3. The forced air drying dishwasher of claim 1 wherein the intake is louvered.

4. The forced air drying dishwasher of claim 2 wherein the intake is louvered.

5. A forced air drying dishwasher comprising:

a substantially rectilinear case having a front side, a front top and a front bottom spaced apart from the front top;

a washing tub disposed within the case, the washing tub having a ceiling and a floor spaced apart from the ceiling, a back wall and a hinged door spaced apart from the back wall, a first side and a second side spaced apart from the first side;

an interior space disposed within the case, the interior space surrounding the ceiling, the floor, the back wall, the first side, and the second side;

a louvered intake disposed within the front side adjacent the front bottom, the louvered intake having a width equal to a width between the first side and the second side;

an air channel disposed within the interior space below the floor, the air channel having a wide mouth tapered to a narrowed venturi area, the wide mouth affixed adjacent the louvered intake;

a blower disposed within the interior space below the floor, the blower in direct communication with the narrowed venturi area;

a distribution manifold disposed within the interior space, the distribution manifold having:

a plurality of laminar bends;

a transfer tube disposed from the blower to below and proximal the back wall;

a first riser disposed vertically from the transfer tube to a position proximal the ceiling, the first riser disposed proximal the back wall and the second side, the first riser connected to the transfer tube via one laminar bend of the plurality of laminar bends;

a second riser disposed proximal the back wall and the first side;

a transverse tube disposed between the first riser and the second riser, the transverse tube disposed proximal the back wall and the floor, two laminar bends of the plurality of laminar bends connecting the transverse tube from the first riser to the second riser;

wherein the distribution manifold receives an air flow from the blower;

a plurality of horizontally disposed, equally spaced apart nozzle manifolds, the nozzle manifolds equally distributed between proximal the ceiling to proximal the floor, three nozzle manifolds of the plurality of nozzle manifolds proximal the second side and extended from the first riser toward the hinged door, three nozzle manifolds of the plurality of nozzle manifolds proximal the first side and extended from the second riser to proximal the hinged door, the nozzle manifolds connected to each of the first riser and the second riser via a portion of the laminar bends of the plurality of laminar bends;

a plurality of mirror image equally spaced apart nozzles disposed within the first side and the second side, each nozzle of the plurality of nozzles open within the washing tub, three nozzles of the plurality of nozzles connected to each nozzle manifold of the plurality of nozzle manifolds;

wherein the plurality of nozzles delivers the air flow from the distribution manifold by way of the plurality of nozzle manifolds to the interior space;

an exhaust disposed within the interior space, the exhaust having a gradual bend disposed between the ceiling and the front top;

an inlet grill disposed between the exhaust and the ceiling;

an outlet grill disposed between the exhaust and the front top;

a washing mechanism disposed within the case, the washing mechanism having:

a revolving washer disposed within the floor;

a plurality of spray jets disposed within the revolving washer;

a water connection;

a power connection; and a control panel disposed within the front top, the control panel in operational communication with the blower and the washing mechanism.

6. A forced air drying dishwasher comprising:

a substantially rectilinear case having a front side, a front top and a front bottom spaced apart from the front top;

a washing tub disposed within the case, the washing tub having a ceiling and a floor spaced apart from the ceiling, a back wall and a hinged door spaced apart from the back wall, a first side and a second side spaced apart from the first side;

an interior space disposed within the case, the interior space surrounding the ceiling, the floor, the back wall, the first side, and the second side;

a louvered intake disposed within the front side adjacent the front bottom, the louvered intake having a width equal to a width between the first side and the second side;

an air channel disposed within the interior space below the floor, the air channel having a wide mouth tapered to a narrowed venturi area, the wide mouth affixed adjacent the louvered intake;

a blower disposed within the interior space below the floor, the blower in direct communication with the narrowed venturi area;

a heating element disposed within the interior space below the floor, the heating element in operational communication with the blower;

a distribution manifold disposed within the interior space, the distribution manifold having:

a plurality of laminar bends;

a transfer tube disposed from the heating element to below and proximal the back wall;

a first riser disposed vertically from the transfer tube to a position proximal the ceiling, the first riser disposed proximal the back wall and the second side, the first riser connected to the transfer tube via one laminar bend of the plurality of laminar bends;

a second riser disposed proximal the back wall and the first side;

a transverse tube disposed between the first riser and the second riser, the transverse tube disposed proximal the back wall and the floor, two laminar bends of the plurality of laminar bends connecting the transverse tube from the first riser to the second riser;

wherein the distribution manifold receives a heated air flow from the blower;

a plurality of horizontally disposed, equally spaced apart nozzle manifolds, the nozzle manifolds equally distributed between proximal the ceiling to proximal the floor, three nozzle manifolds of the plurality of nozzle manifolds proximal the second side and extended from the first riser toward the hinged door, three nozzle manifolds of the plurality of nozzle manifolds proximal the first side and extended from the second riser to proximal the hinged door, the nozzle manifolds connected to each of the first riser and the second riser via a portion of the laminar bends of the plurality of laminar bends;

a plurality of mirror image equally spaced apart nozzles disposed within the first side and the second side, each nozzle of the plurality of nozzles open within the washing tub, three nozzles of the plurality of nozzles connected to each nozzle manifold of the plurality of nozzle manifolds;

wherein the plurality of nozzles delivers the heated air flow from the distribution manifold by way of the plurality of nozzle manifolds to the interior space;

an exhaust disposed within the interior space, the exhaust having a gradual bend disposed between the ceiling and the front top;

an inlet grill disposed between the exhaust and the ceiling;

an outlet grill disposed between the exhaust and the front top;

a washing mechanism disposed within the case, the washing mechanism having;

a revolving washer disposed within the floor;

a plurality of spray jets disposed within the revolving washer;

a water connection;

a power connection; and a control panel disposed within the front top, the control panel in operational communication with the blower, the heating element, and the washing mechanism.

* * * * *